US010130125B2

(12) United States Patent
Sanguinetti

(10) Patent No.: US 10,130,125 B2
(45) Date of Patent: Nov. 20, 2018

(54) BIB GARMENT FOR PROTECTING BABY'S AND PATIENT'S CLOTHING

(71) Applicant: Gina Shami Sanguinetti, San Mateo, CA (US)

(72) Inventor: Gina Shami Sanguinetti, San Mateo, CA (US)

( * ) Notice: Subject to any disclaimer, the term of this patent is extended or adjusted under 35 U.S.C. 154(b) by 46 days.

(21) Appl. No.: 14/941,905

(22) Filed: Nov. 16, 2015

(65) Prior Publication Data

US 2017/0055594 A1 Mar. 2, 2017

Related U.S. Application Data

(60) Provisional application No. 62/050,374, filed on Sep. 15, 2014.

(51) Int. Cl.
*A41B 13/10* (2006.01)

(52) U.S. Cl.
CPC ..... *A41B 13/10* (2013.01); *A41B 2300/33* (2013.01)

(58) Field of Classification Search
CPC ..... A41B 13/10; A41B 13/103
See application file for complete search history.

(56) References Cited

U.S. PATENT DOCUMENTS 2,831,193 A * 4/1958 Terry ..... A41B 13/10 2/46
3,945,048 A * 3/1976 Shearer ..... A41B 13/103 2/48
5,432,952 A * 7/1995 Tate ..... A41B 13/10 2/119
6,182,290 B1 * 2/2001 Morris ..... A41B 13/10 2/49.1
2009/0017615 A1 * 1/2009 Oh ..... H01L 21/31116 438/643
2009/0044307 A1 * 2/2009 Johnson ..... A41B 13/10 2/49.1
2010/0107294 A1 * 5/2010 Gillian ..... A41B 13/10 2/49.5
2011/0179543 A1 * 7/2011 Yoo ..... A41B 13/10 2/49.2
2014/0020148 A1 * 1/2014 Yaep ..... A41B 13/10 2/49.1
2014/0250557 A1 * 9/2014 Amrikhas ..... A41B 13/103 2/49.2

(Continued)

*Primary Examiner* — Kristen Matter
(74) *Attorney, Agent, or Firm* — Indrajana Law Group, a PLC

(57) ABSTRACT

A bib garment for protecting a baby's clothing is disclosed. According to one embodiment, a bib garment comprises an inner section, the inner section comprising a front layer constructed using a soft absorbent material and a liquid-proof material, the inner section further comprising a first back layer constructed using a soft hypo-allergenic material. The bib garment further comprises an outer section, the outer section comprising a back layer constructed using a liquid-proof material. A top end of the inner section and top end of the outer section are joined at a fold line. The bib garment further comprises a first strap and a second strap, each of the first and second straps having a first end attached to the fold line and a second end having removable attachment materials, wherein the second end of the first strap is removably attachable to the second end of the second strap.

27 Claims, 9 Drawing Sheets

(56) References Cited

U.S. PATENT DOCUMENTS

| | | | | |
|---|---|---|---|---|
| 2014/0250558 | A1* | 9/2014 | Russo | A41B 13/10 2/49.4 |
| 2014/0250560 | A1* | 9/2014 | Martinez | A41B 13/10 2/52 |

* cited by examiner

BIB GARMENT FOR PROTECTING BABY'S AND PATIENT'S CLOTHING

CROSS REFERENCE TO RELATED APPLICATIONS

The present application claims priority to U.S. Provisional Application Ser. No. 62/050,374, titled "BIB GARMENT FOR PROTECTING BABY'S CLOTHING" filed on Sep. 15, 2014, the entirety of which is incorporated herein by reference.

FIELD

The embodiments herein relate generally to protective garments used by parents and care takers while feeding babies or patients and, more particularly, to a bib garment for protecting the baby's and patient's clothing.

BACKGROUND

In the course of taking care of a baby, it is difficult to protect the clothing of the baby while feeding the baby. This leads to excessive clothing changes, laundering of clothing, and extra time spent cleaning up. Bibs are well known items used to help minimize the problem of food soiling a baby's clothing. However, bibs do not provide an impenetrable barrier to food running down the face of the child and soiling the child's shirt and perhaps undergarments.

Food not only runs down the front of the child's chin, food can also run down the side of the child's face, down the child's neck and down the child's chest. A significant shortcoming of a traditional bib is that the baby spits up while he/she is sitting up, laying back at an angle or laying flat down on the back. The baby's head is usually turned resting against an object like an infant car seat, for example, when the spit up occurs. Most often, the spit up is not projectile.

It would, therefore, be desirable to provide a garment to protect against food running down a baby's or patient's face and into the baby's or patient's garment.

SUMMARY

A bib garment for protecting a baby's clothing is disclosed. According to one embodiment, a bib garment comprises an inner section, the inner section comprising a front layer constructed using a soft absorbent material and a liquid-proof material, the inner section further comprising a first back layer constructed using a soft hypo-allergenic material. The bib garment further comprises an outer section, the outer section comprising a back layer constructed using a liquid-proof material. A top end of the inner section and top end of the outer section are joined at a fold line. The bib garment further comprises a first strap and a second strap, each of the first and second straps having a first end attached to the fold line and a second end having removable attachment materials, wherein the second end of the first strap is removably attachable to the second end of the second strap.

The systems, methods, features and advantages of the invention will be or will become apparent to one with skill in the art upon examination of the following figures and detailed description. It is intended that all such additional methods, features and advantages be included within this description, be within the scope of the invention, and be protected by the accompanying claims. It is also intended that the invention is not limited to require the details of the example embodiments.

BRIEF DESCRIPTION

The accompanying drawings, which are included as part of the present specification, illustrate the presently preferred embodiment and, together with the general description given above and the detailed description of the preferred embodiment given below, serve to explain and teach the principles of the present invention.

Figure 6A:
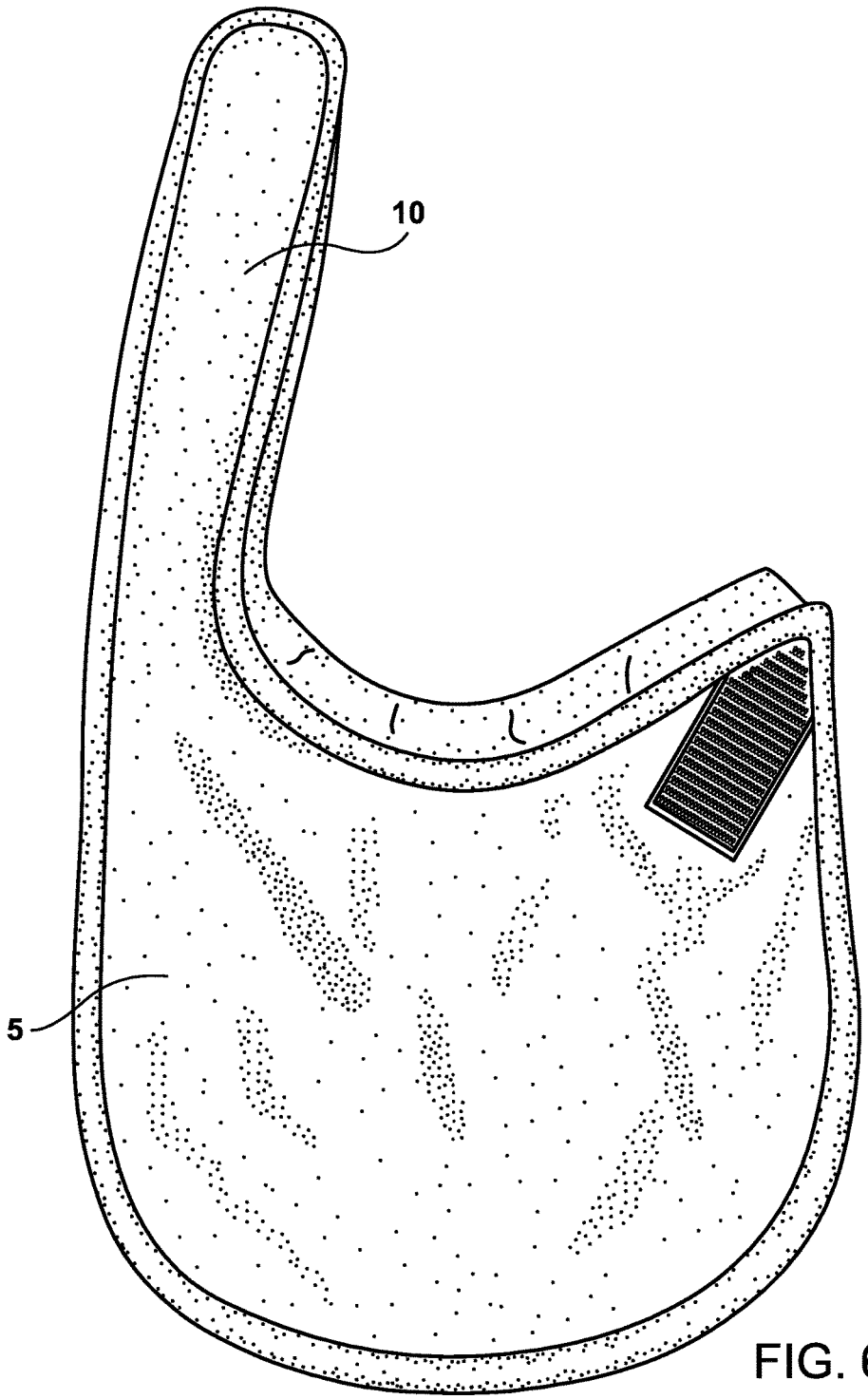

FIG. 6*a* illustrates a front view of an exemplary bib garment according to one embodiment of the present invention.

Figure 6B:
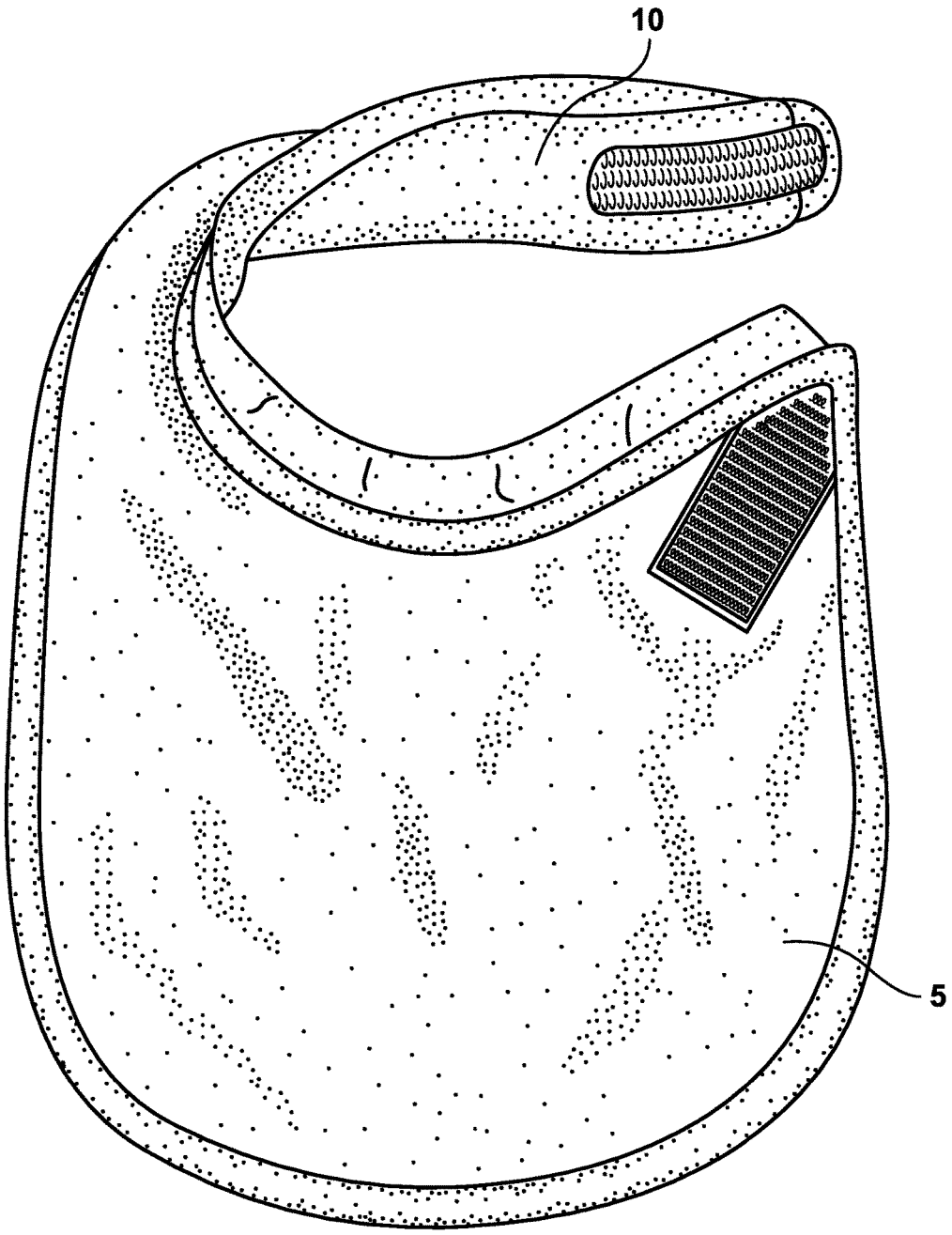

FIG. 6*b* illustrates a strap view of an exemplary bib garment according to one embodiment of the present invention.

Figure 6C:
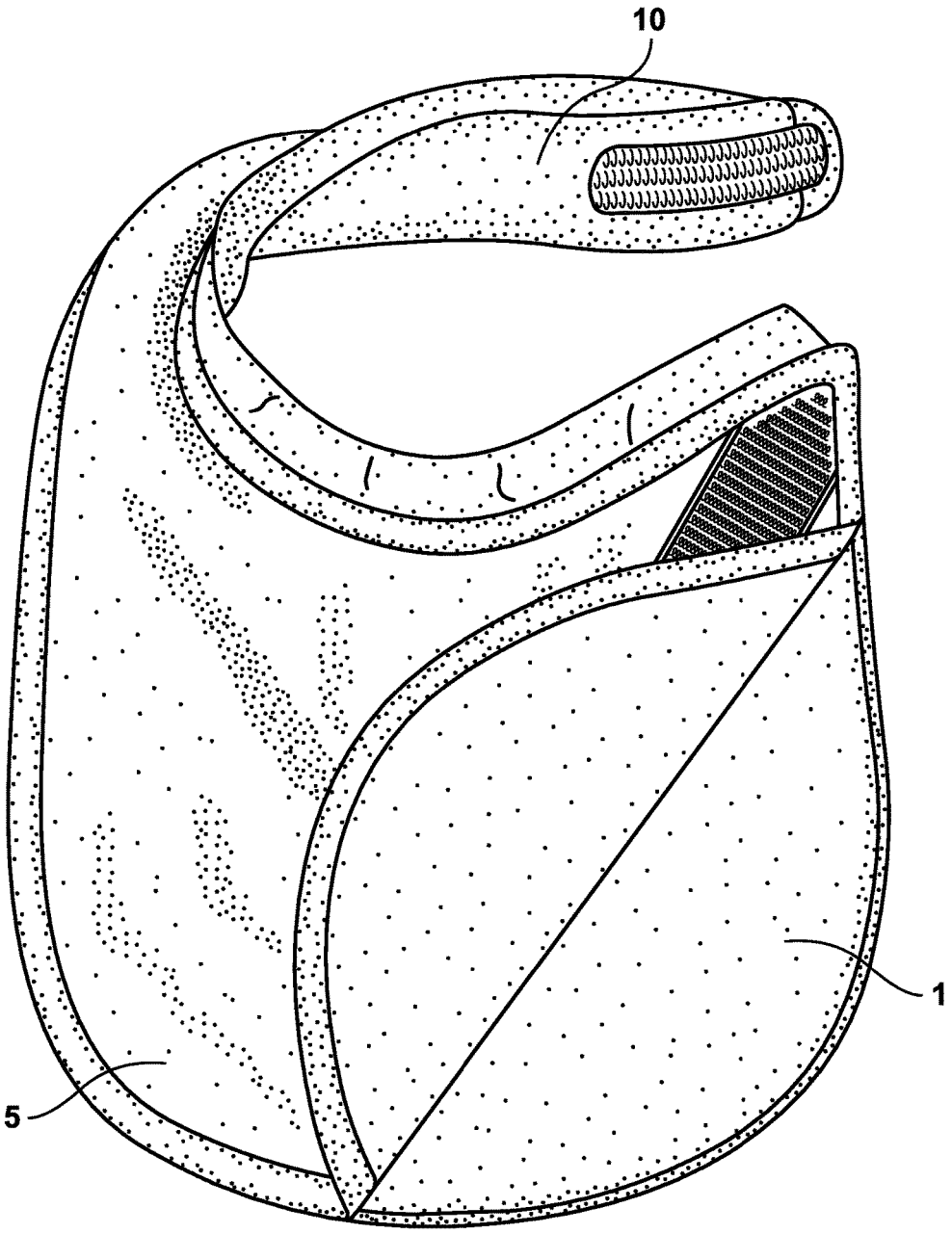

FIG. 6*c* illustrates a front and middle view of an exemplary bib garment according to one embodiment of the present invention.

Figure 6D:
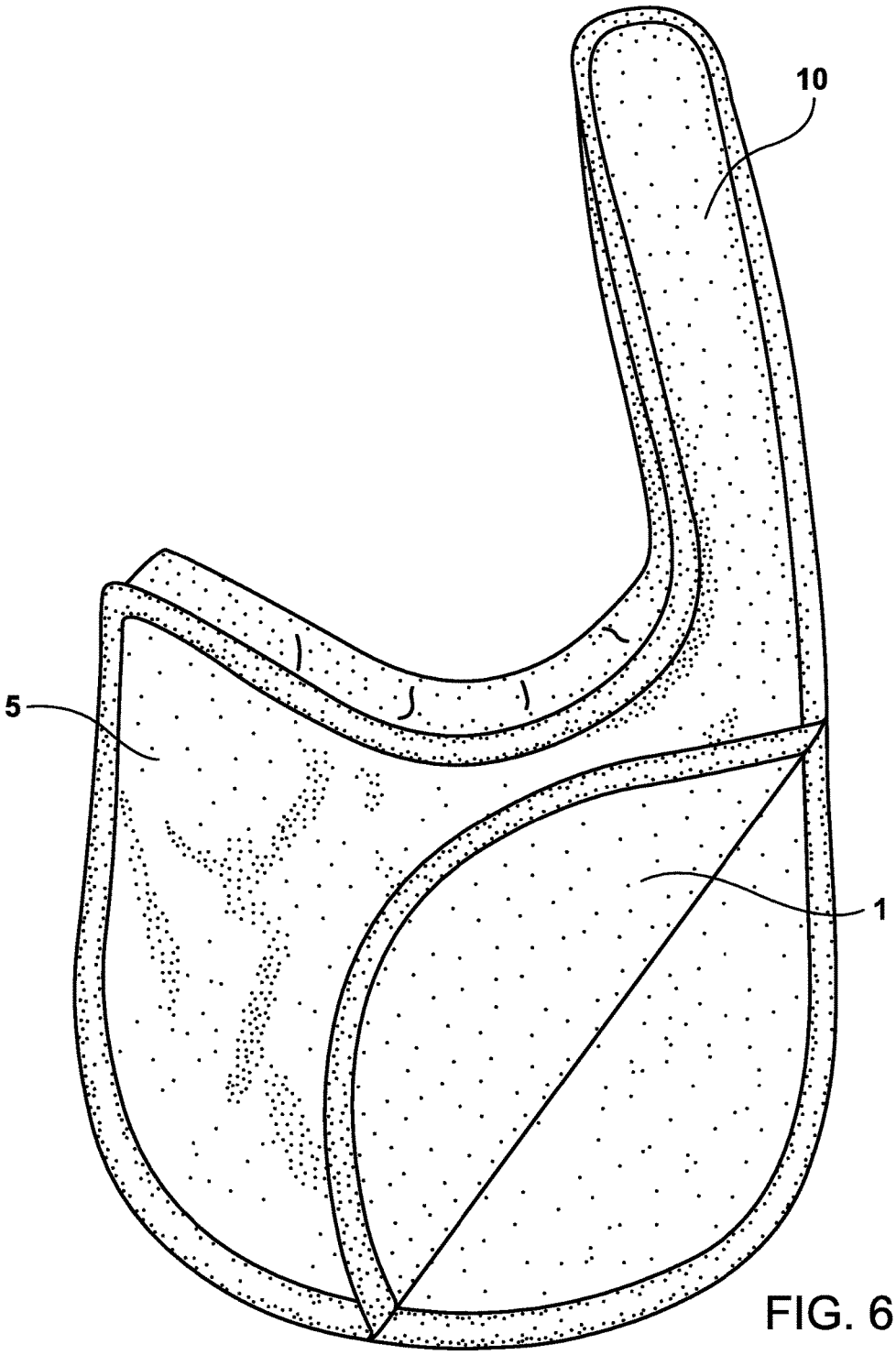

FIG. 6*d* illustrates a rear view of an exemplary bib garment according to one embodiment of the present invention.

It should be noted that the figures are not necessarily drawn to scale and that elements of similar structures or functions are generally represented by like reference numerals for illustrative purposes throughout the figures. It also should be noted that the figures are only intended to facilitate the description of the various embodiments described herein. The figures do not necessarily describe every aspect of the teachings disclosed herein and do not limit the scope of the claims.

DETAILED DESCRIPTION

Reference now will be made in detail to embodiments of the present disclosure, examples of which are illustrated in the accompanying drawings. Wherever possible, the same reference numbers will be used throughout the drawings to refer to the same or like parts and/or components.

According to one embodiment of the present disclosure, a bib garment is provided that prevents soiling of a child's clothing. The bib garment protects, in particular, the clothing covering the upper portion of the child's body. It will be appreciated that the bib garment can also protect other clothing worn by the child. The bib garment is convenient to wear and remove, and is preferably constructed of materials that are easily laundered and durable for lasting reuse.

Figure 1:
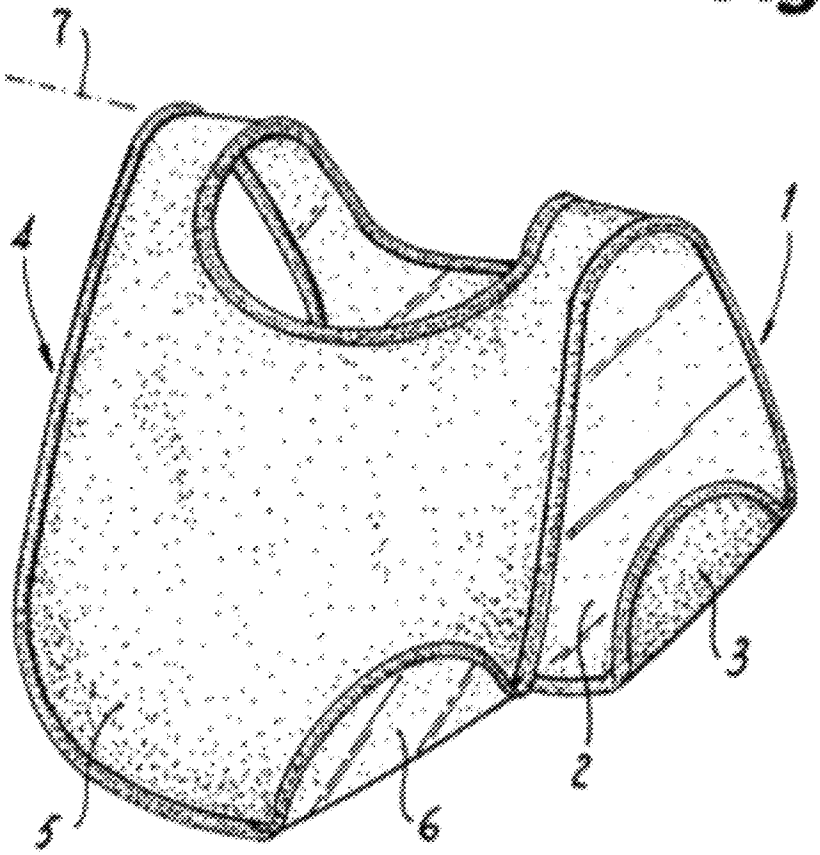
FIG. 1 illustrates an exemplary bib garment, according to one embodiment.
Figure 2:
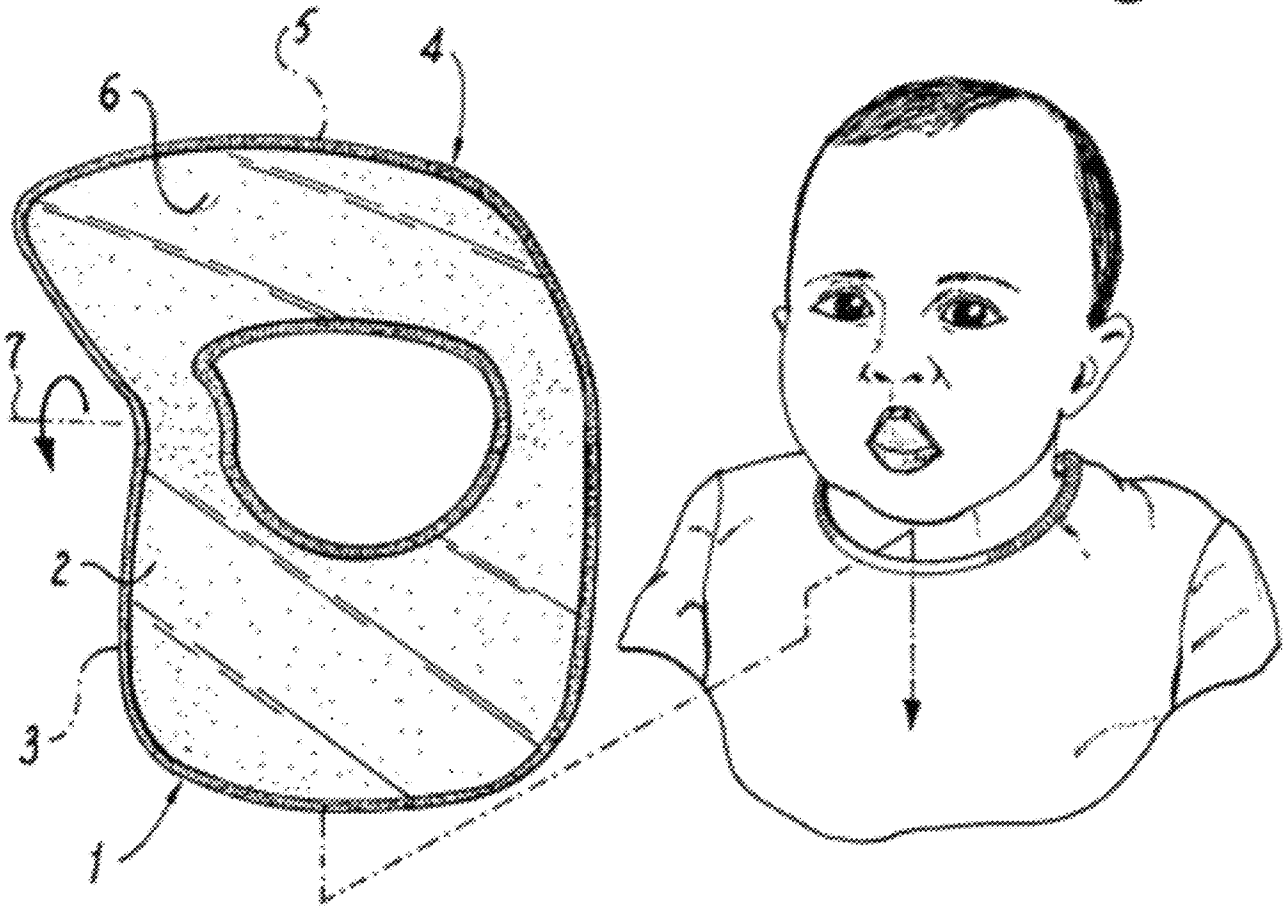
FIG. 2 illustrates an exemplary bib garment and application thereof, according to one embodiment.

FIG. 1 illustrates an exemplary bib garment and FIG. 2 illustrates an exemplary application thereof, according to one embodiment.

A bib garment according to one embodiment of the present disclosure comprises a panel 4 having an inner section 1 joined to an outer section 5. Where the inner section and outer section intersect at a fold line 7, a laminated surface provides a seal to eliminate passage of liquids under the bib garment. As shown in FIGS. 1 and 2, the inner section 1 and the outer section 5 have substantially the same area.

According to one embodiment, the outer section 5 is preferably constructed using cotton and comprises a back layer 6. The back layer 6 is preferably constructed using thermoplastic polyurethane. It will be appreciated, however, that any liquid-proof backing can be used as the back layer 6 without departing from the scope of the present disclosure. It is contemplated that the back layer 6 comprises the laminated surface described above as providing a seal at the fold line 7. It is also contemplated that the laminated surface described above as providing a seal at the fold line 7 is layered in addition to the back layer 6.

According to one embodiment, the inner section 1 comprises a front layer 2 preferably constructed using cotton and a thermoplastic polyurethane backing. The inner section 1 further comprises a back layer 3 preferably constructed using a soft hypo-allergenic material (e.g. cotton, fleece, flannel, or any soft absorbent material suitable for contact with a child's skin).

The outer section 5 of the bib garment drapes over the top of a child's clothing over the child's chest and abdomen. The inner section 1 of the bib garment is positioned between the child's skin and the child's clothing, by tucking the inner section 1 through the neck opening of the child's upper garment.

Figure 3:
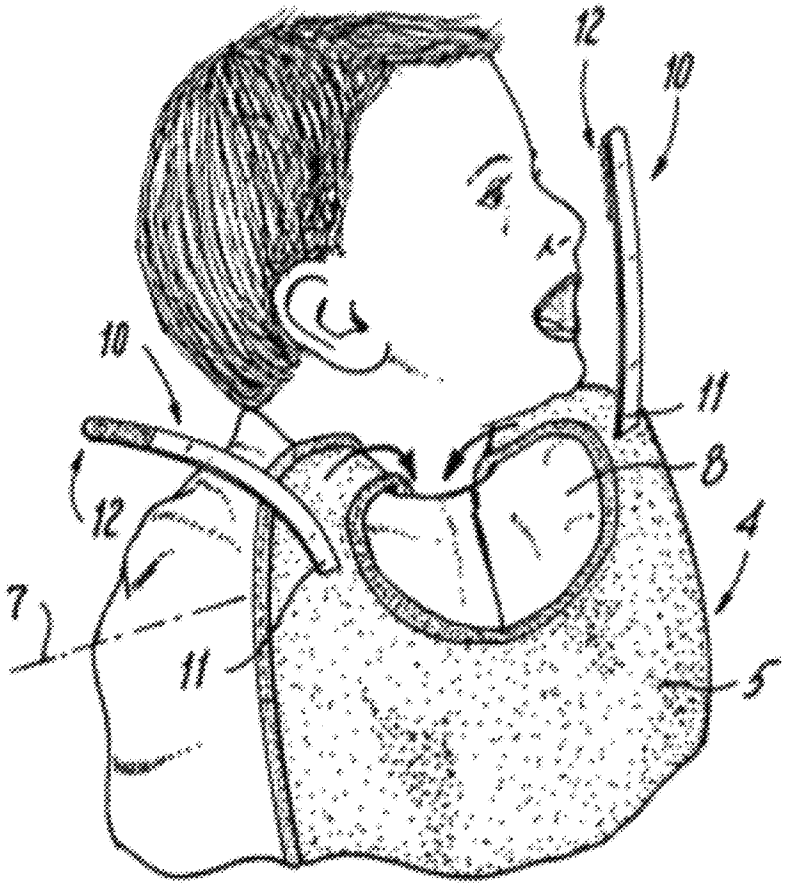
FIG. 3 illustrates an exemplary bib garment and another application thereof, according to one embodiment.

FIG. 3 further illustrates an exemplary application of the present bib garment, according to one embodiment. The garment is draped over the child's upper garment 8. The outer section 5 of the bib garment drapes over the top of a child's clothing over the child's chest and abdomen. The inner section 1 of the bib garment is positioned between the child's skin 9 and the child's clothing 8. Straps 10 are attached to the bib garment at fold line 7 and extend over the child's shoulders and at least partway around the child's neck. Free ends 12 of the straps 10 join behind the child's neck. Examples of removable securement for joining the straps 10 include snaps, hook and eye closures such as VELCRO, and magnets. It will be appreciated that any suitable means for removably joining the straps 10 can be used without departing from the scope of the present disclosure. It will also be appreciated that the garment can have a single strap extending from one side of the child or patient's neck, around back of the neck, and removably attaching to the garment on the other side of the child or patient's neck.

Figure 4:
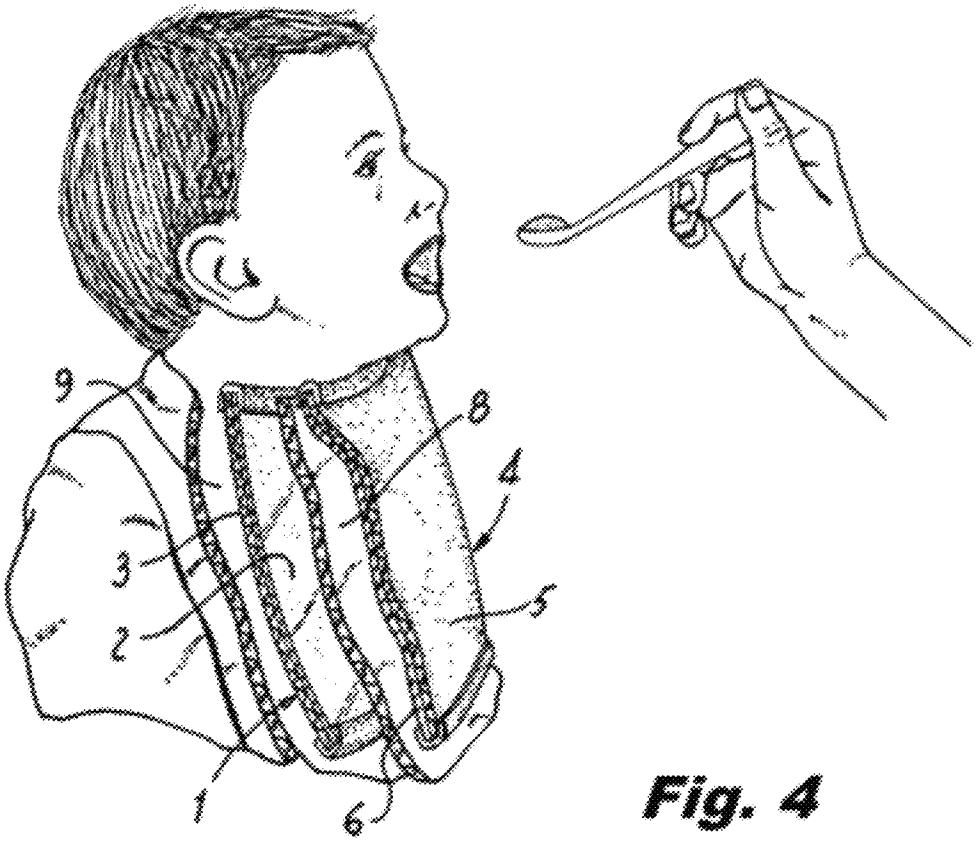
FIG. 4 illustrates an exemplary exploded view of an exemplary bib garment as worn by a child, according to one embodiment.

FIG. 4 illustrates an exemplary exploded view of an exemplary bib garment as worn by a child, according to one embodiment. According to one embodiment, back layer 3 of the bib garment is in contact with the child's skin 9. Front layer 2 of inner section 1 is in contact with the inside of the child's upper garment 8. Back layer 6 of outer section 5 is in contact with the outside of the child's upper garment 8. It will be appreciated that, with such an arrangement, the child's skin and clothing are protected from liquids spilling down the child's chin and neck.

Figure 5:
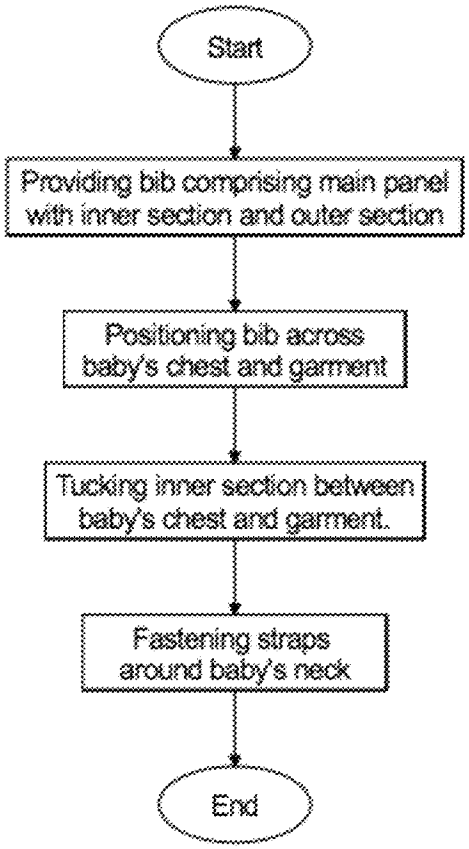
FIG. 5 illustrates an exemplary application process for use with the present bib garment, according to one embodiment.

FIG. 5 illustrates an exemplary application process for use with the present bib garment, according to one embodiment. A bib garment comprising an inner section 1 and an outer section 5 are positioned across a child's chest 9 and upper garment 8. The inner section 1 is tucked through a neck opening to be positioned between the child's chest 9 and upper garment 8. The outer section 5 is draped on top of the upper garment 8. Straps 10 are fastened by suitable attachment means 12 around the child's neck. It will be appreciated that straps 10 can be attached to the sides of the child's neck instead of around the back of the neck without departing from the scope of the present disclosure.

FIG. 6*a* illustrates a front view of an exemplary bib garment according to one embodiment of the present invention.

FIG. 6*b* illustrates a strap view of an exemplary bib garment according to one embodiment of the present invention.

FIG. 6*c* illustrates a front and middle view of an exemplary bib garment according to one embodiment of the present invention.

FIG. 6*d* illustrates a rear view of an exemplary bib garment according to one embodiment of the present invention.

In FIGS. 6*a*-6*d*, an outer section 5 and inner section 1 can be seen attached to a strap 10.

It will be appreciated that various modifications can be made to the presently disclosed bib garment without departing from the scope of the disclosure. For example, the bib garment should be machine washable. The bib garment may be made from disposable materials, designed for single use while traveling. The disposable materials may be recyclable and/or compostable.

The bib garment should be "child friendly" in various ways that term is meaningful. The bib garment can have toys or music making apparatuses attached thereto, the bib garment can also have an attached pacifier. The bib garment can have various child friendly designs on the outer section 5.

The outer section 5 can comprise an open pocket at the bottom for catching fallen food items or crumbs. According to an additional embodiment, a thicker collar is added around the neck.

According to one embodiment, inner section 1 and outer section 5 each include a magnet such that they are attracted to each other resulting in being held in place on the child.

It will be appreciated that the present garment is applicable to any human being fed, including aging adults or those adults in situations requiring assistance in being fed.

A bib garment for protecting a baby's clothing has been disclosed. It is understood that the embodiments described herein are for the purpose of elucidation and should not be considered limiting the subject matter of the disclosure. Various modifications, uses, substitutions, combinations, improvements, methods of productions without departing from the scope or spirit of the present invention would be evident to a person skilled in the art.

I claim:

1. A bib garment for preventing soiling of a garment worn underneath the bib, the bib garment comprising:

a. an inner section for positioning between the wearer's skin and the wearer's garment, the inner section comprising a front layer comprising a soft absorbent material and a liquid-proof material, and a first back layer comprising a soft hypoallergenic material;

b. an outer section for draping over a front of the wearer's garment, the outer section comprising a back layer comprising a liquid-proof material; and c. first and second straps, each of the first and second straps having a first end attached to a fold line joining the inner and outer sections and a second end having a removable attachment mechanism, wherein the second end of the first strap is removably attachable to the second end of the second strap for securing the straps behind the wearer's neck; wherein the inner section and the outer section have substantially the same area and wherein a top end of the inner section and a top end of the outer section are joined at a the fold line.

2. The bib garment of claim 1, wherein the soft absorbent material is one of cotton, fleece, or flannel.

3. The bib garment of claim 1, wherein the liquid-proof material is thermoplastic polyurethane.

4. The bib garment of claim 1, wherein the fold line comprises a laminated surface.

5. The bib garment of claim 1, wherein the bib-garment is machine-washable.

6. The bib garment of claim 1, wherein the inner section and outer section are constructed entirely from disposable materials.

7. The bib garment of claim 6, wherein the disposable materials are one or more of recycled, recyclable, composted, and compostable.

8. The bib garment of claim 1, wherein the removable attachment mechanisms are one of snaps, hook and eye closures, and magnets.

9. The bib garment of claim 1, wherein the outer section further comprises an open pocket at a bottom end of the outer section for catching fallen food items.

10. A method for preventing soiling of a garment, the method comprising:

positioning a bib garment comprising an inner section and an outer section across a wearer's chest and garment, the inner section and the outer section having substantially the same area, the inner section comprising a front layer comprising a soft absorbent material and a liquid-proof material, the inner section further comprising a first back layer comprising a soft hypoallergenic material, the outer section comprising a back layer comprising a liquid proof material, wherein a top end of the inner section and J top end of the outer section are joined at a fold line;

tucking the inner section through a neck opening of the garment such that the inner section is positioned between the wearer's chest and garment;

draping the outer section on a front of the garment; and fastening the bib garment around the wearer's neck using a first strap and a second strap of the bib garment, each of the first and second straps having a first end attached to the fold line and a second end having a removable attachment mechanism, wherein the second end of the first strap is removably attachable to the second end of the second strap.

11. The method of claim 10, wherein the soft absorbent material is one of cotton, fleece, or flannel.

12. The method of claim 10, wherein the liquid-proof material is thermoplastic polyurethane.

13. The method of claim 10, wherein the fold line comprises a laminated surface.

14. The method of claim 10, wherein the bib garment is machine-washable.

15. The method of claim 10, wherein the inner section and outer section are constructed entirely from disposable materials.

16. The method of claim 15, wherein the disposable materials are one or more of recycled, recyclable, composted, and compostable.

17. The method of claim 10, wherein the removable attachment mechanisms are one of snaps, hook and eye closures, and magnets.

18. The method of claim 10, wherein the outer section further comprises an open pocket at bottom end of the outer section for catching fallen food items.

19. A bib garment for preventing soiling of a garment, the bib garment comprising:

a. an inner section for positioning between a wearer's skin and the garment, the inner section comprising a front layer comprising a soft absorbent material and a liquid-proof material, and a first back layer comprising a soft hypoallergenic material;

b. an outer section for draping over a front of the garment, the outer section comprising a back layer comprising a liquid-proof material; wherein a top end of the inner section and a top end of the outer section are joined at a fold line; and c. a strap having a first end attached to the fold line joining the inner and outer sections and a second end having a removable attachment mechanism; wherein the second end of the strap is removably attachable to the fold line for securing the strap behind the wearer's neck; and wherein the inner section and the outer section have substantially the same area.

20. The bib garment of claim 19, wherein the soft absorbent material is one of cotton, fleece, or flannel.

21. The bib garment of claim 19, wherein the liquid-proof material is thermo-plastic polyurethane.

22. The bib garment of claim 19, wherein the fold line comprises a laminated surface.

23. The bib garment of claim 19, wherein the bib-garment is machine-washable.

24. The bib garment of claim 19, wherein the inner section and outer section are constructed entirely from disposable materials.

25. The bib garment of claim 24, wherein the disposable materials are one or more of recycled, recyclable, composted, and compostable.

26. The bib garment of claim 19, wherein the removable attachment mechanisms are one of snaps, hook and eye closures, and magnets.

27. The bib garment of claim 19, wherein the outer section further comprises an open pocket at a bottom end of the outer section for catching fallen food items.

* * * * *